US005929697A

United States Patent [19]

Chang

[11] Patent Number: 5,929,697

[45] Date of Patent: Jul. 27, 1999

[54] CURRENT REFERENCE CIRCUIT FOR CURRENT-MODE READ-ONLY-MEMORY

[75] Inventor: Kok Chin Chang, Singapore, Singapore

[73] Assignee: Tritech Microelectronics International, Ltd., Singapore, Singapore

[21] Appl. No.: 08/893,638

[22] Filed: Jul. 11, 1997

[51] Int. Cl.[6] ..... G05F 3/02

[52] U.S. Cl. ..... 327/543; 327/538; 327/541; 323/315

[58] Field of Search ..... 327/538, 541, 327/543; 323/312, 315

[56] References Cited

U.S. PATENT DOCUMENTS 4,103,249 7/1978 Burdick ..... 323/315
4,464,591 8/1984 Rapp .
4,675,594 6/1987 Reinke ..... 327/542
5,257,039 10/1993 Chung et al. ..... 323/315
5,304,863 4/1994 Fruhauf et al. ..... 327/538
5,635,869 6/1997 Ferraiolo et al. ..... 327/534
5,798,637 8/1998 Kim et al. ..... 323/313

*Primary Examiner*—Terry D. Cunningham
*Attorney, Agent, or Firm*—George O. Saile; Stephen B. Ackerman

[57] ABSTRACT

A current reference circuit for use in a memory sense amplifier is described, which generates a mid-point current reference that is insensitive to fabrication process variations. This circuit is also robust enough to handle distinctly different levels of "0" and "1" sense currents without causing clipping of the mid-point reference current. Adequate sensing levels for the bit line sense amplifier are thus ensured.

13 Claims, 3 Drawing Sheets

CURRENT REFERENCE CIRCUIT FOR CURRENT-MODE READ-ONLY-MEMORY

BACKGROUND OF THE INVENTION

1. Field of the Invention

This invention relates to the field of current reference circuits for memory sense amplifiers.

2. Description of the Prior Art

FIG. 1 is a schematic diagram of a prior art current difference sense amplifier as disclosed in U.S. Pat. No. 4,464,591 (Rapp, August 1984). The circuit is made up of n-channel transistors powered from a $V_{DD}$ power supply connected positive to terminal 10 and negative to ground terminal 11. The amplifier has an input terminal 12 which drives $I_{SIG}$ into current sink 13. Current sink 13 represents the current being sensed in a memory array. Output terminal 25 provides the amplified output. Transistor 17, connected as a common source inverting stage, with depletion load transistor 18, is connected to input terminal 12. The inverting stage output, the drain, is directly coupled to the gate of transistor 15. Thus inverter 17 acts as a negative feedback loop around the transistor 15 gate to its source, stabilizing its bias.

When $I_{SIG}$ is at zero, transistor 15 will pull terminal 12 up and turn on transistor 17 which will pull the gate of transistor 15, along with its source, down and stabilize the circuit operating point. The voltage drop across transistor 18 due to the current in transistor 17 will seek the level of cutoff of transistor 15 just described. For zero current input, transistor 17 is conducting and transistor 15 is cut off.

When $I_{SIG}$ is at a logic "one," or about fifty microamperes, terminal 12 will get pulled down slightly thereby reducing the current in transistor 17. Thus, the drain of transistor 17 will rise and turn transistor 15 on enough to conduct $I_{SIG}$. Since only fifty microamperes need to be conducted in transistor 15 the rise of its gate voltage is relatively small. Because transistor 17 is an amplifying inverter the change in voltage between the source and gate of transistor 15 will be much larger than the shift in gate voltage on transistor 17.

The sense amplifier of FIG. 1, when used in a semiconductor memory chip, will normally be repeated as often as needed. A single current reference circuit (21) will then be used to provide a plurality of current sinks, one for each amplifier. FIG. 2 is a schematic diagram of such a prior art current reference circuit as disclosed in the same patent quoted above, U.S. Pat. No. 4,464,591 (Rapp, August 1984).

Current $I_M$ flowing into current sink 30 represents a pseudo value related to the $I_{SIG}$ memory current detailed in FIG. 1. $I_M$ typically gets developed in a dummy memory cell which is programmed for a logic "one". The current reference circuit functions exactly the same as the sense amplifier circuit of FIG. 1. The type and arrangement of transistors 31, 32, 33, and 34 is exactly the same as the type and arrangement of transistors 15, 17, 18 and 20. Transistor 34 is the source follower which passes current $I_3$ through transistor 35 which has its gate connected to its drain. Transistor 35 acts as a current mirror with transistors 36–39 which provide the individual reference currents to the individual sense amplifiers.

SUMMARY OF THE INVENTION

It is an object of the present invention to provide a current reference circuit insensitive to fabrication process variations.

It is another object of the present invention to provide a current reference robust enough to handle distinctly different levels of "0" and "1" currents.

It is yet another object of the present invention to prevent clipping of the reference current near the "0" or "1" level.

These objects have been achieved by duplicating the branches of the reference circuit, by setting up of the differential currents for both "0" and "1" data, and by providing a mid-point averaging connection.

DESCRIPTION OF THE PREFERRED EMBODIMENT

Figure 1:
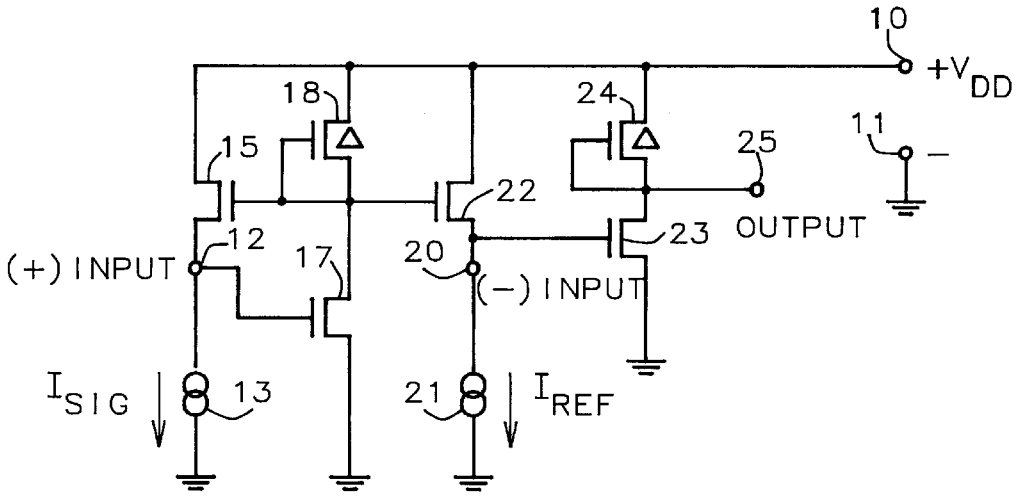
FIG. 1 PRIOR ART
FIG. 1 is a schematic diagram of a typical prior art sense amplifier circuit.
Figure 2:
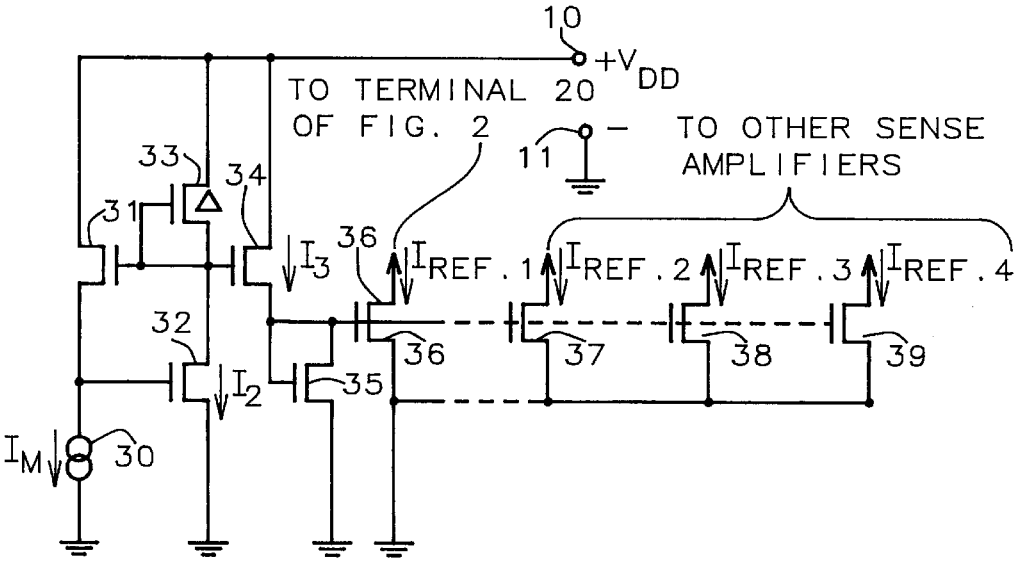
FIG. 2 PRIOR ART
FIG. 2 is a schematic diagram of a typical prior art reference current source circuit.
Figure 3:
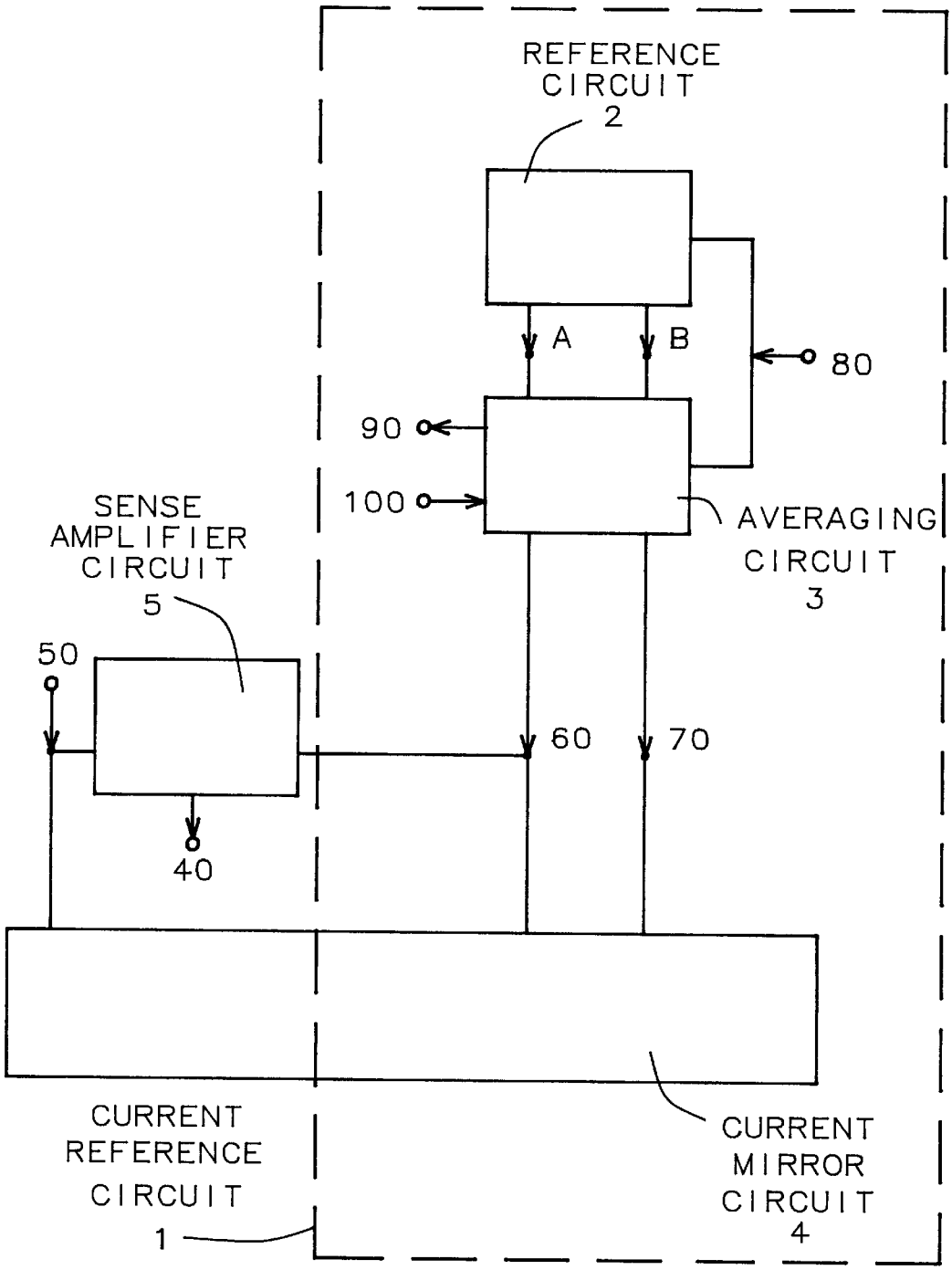
FIG. 3 is a high level block diagram of FIG. 4.

Referring to FIG. 3 we show now a high level view of the principle components of this invention. The key feature is the current reference circuit 1 comprising reference circuit 2, averaging circuit 3, and part of the current mirror circuit 4. Outputs A and B connect the reference circuit 2 to the averaging circuit 3. Control input 80 connects to both the reference circuit 2 and the averaging circuit 3. The averaging circuit 3 connects to feedback output 90 and feedback input 100. Averaging circuit 3 also connects to current mirror circuit 4 at first current reference 60 and second current reference 70 . Terminal 60 also connects to sense amplifier 5. Sense amplifier input 50 connects to both current mirror circuit 4 and sense amplifier circuit 5. Terminal 40 is the output of sense amplifier 5.

Figure 4:
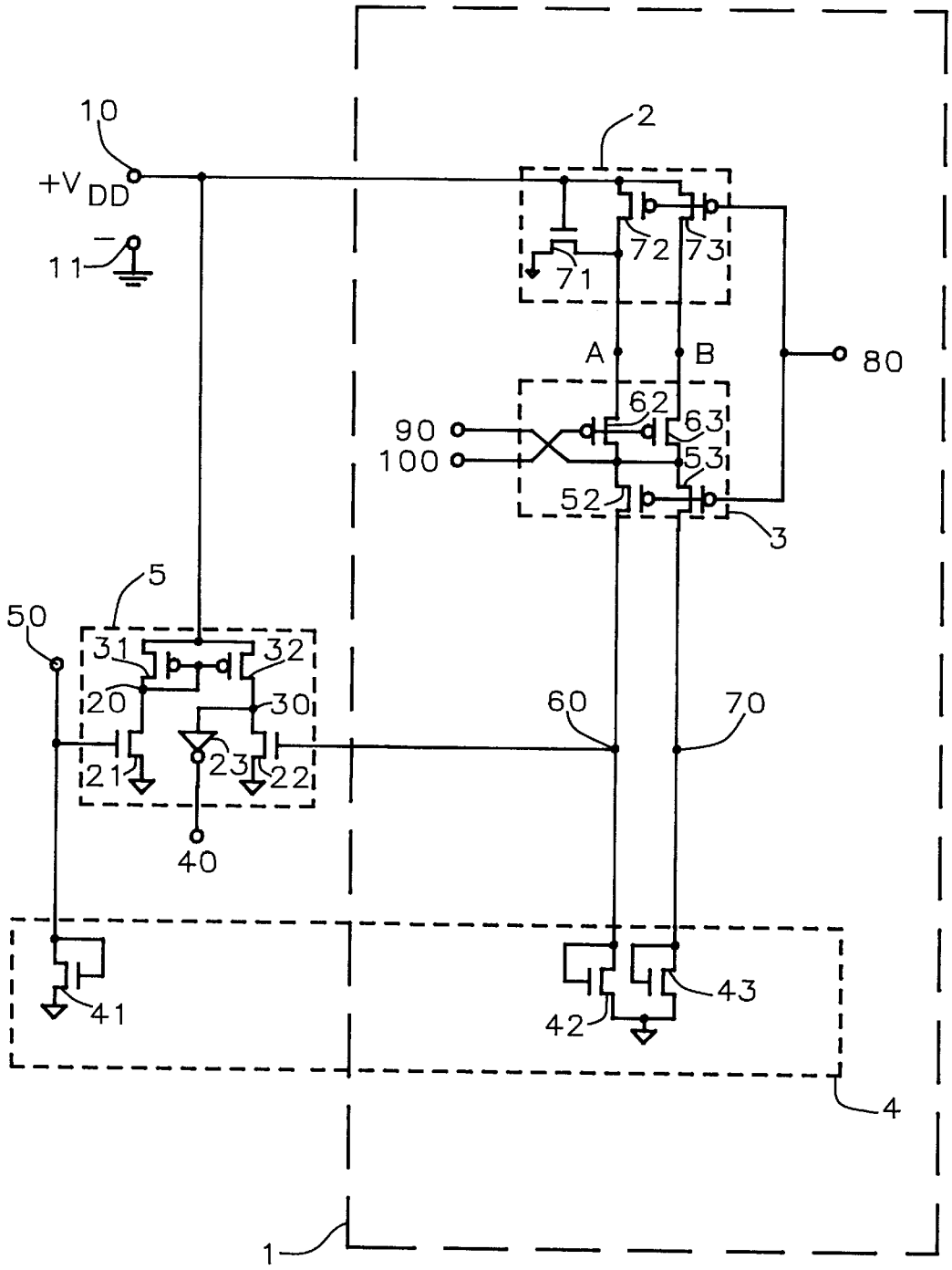
FIG. 4 is a schematic diagram of the current reference circuit and the sense amplifier circuit.

FIG. 4 shows the current reference circuit 1 and its connection to the sense amplifier circuit 5 at first current reference output 60. Both circuits are powered from a $V_{DD}$ power supply connected positive to terminal 10 and negative to ground terminal 11. All transistors are n-channel or p-channel enhancement devices. The current reference circuit 1 consists of duplicated branches to set up the sum of the differential currents for both "0" and "1" data.

The function of reference circuit 2 is to provide reference levels for "0" and "1" data. It consists of n-channel transistor 71 and p-channel transistors 72 and 73. The gate of transistor 71 is tied to $V_{DD}$, thus making it conducting. This is the so called "memory dummy cell," and represents "0" data. When control input 80 is low both transistors 72 and 73 will conduct forcing output B up and output A to an intermediate voltage level which is based on the channel dimensions of both transistors 71 and 72. The current flowing through output A is the current through transistor 72 ($I_{load}$) minus the current through transistor 71 ($I_{cell}$), while the current through output B is the current through transistor 73, which is equal to $I_{load}$. Thus $I_{load}$–$I_{cell}$ through A represents "0" data and $I_{load}$ through B represents "1" data. The cell reference current flowing through points 60 as well as point 70 is half of the sum of the currents through A and B:

$$\frac{I_{ref}}{2} = \frac{2I_{load} - I_{cell}}{2}$$

Since $I_{load}$–$I_{cell}$ represents "0" data and $I_{load}$ represents "1" data the following equation holds:

$$I_{load} - I_{cell} < \frac{2I_{load} - I_{cell}}{2} < I_{load}$$
$$"0"data < ref.current < "1"data$$

This reference current is always between the currents for "0" and "1" data and is a robust mid-point current value for comparison with "0" and "1" data during a read operation. Outputs A and B represent the differential currents for the "1" and "0" data.

The averaging circuit 3 is designed to produce the average of the differential currents discussed above. Four identical p-channel transistors 62, 63, 52 and 53 are used, having the identical channel widths and channel lengths. These four transistors are also to be placed adjacent to each other to make the circuit insensitive to fabrication process variations. Terminal A connects to transistor 62 which connects to transistor 52. Similarly terminal B connects to transistor 63 which connects to transistor 53.

The gates of transistors 62 and 63 connect to feed input 100, while their drains connect to feed output 90. The connection of their drains establishes the mid-point reference which is the sum of the differential currents for the "1" and "0" data. Transistors 52, 53, 62 and 63 have the same channel lengths and widths and are placed adjacent to each other; this makes the mid-point reference insensitive to fabrication process variations. The gates of transistors 52 and 53 connect to control input 80 to provide isolation when input 80 is up i.e. the p-channel transistors 52, 53, 72, and 73 are turned off. Transistors 52 and 53 are connected to outputs labeled first current reference 60 and second current reference 70 respectively. Feed output 90 is connected to the gate of a p-channel transistor similar to 62 in a memory bitline and feed input 100 connects to the source of that transistor. This memory bitline ultimately feeds sense amplifier input 50.

The current load circuit 4 provides a stable output for sense amplifier 5. The three n-channel transistors 41, 42, and 43 have the same channel width and channel length. The first current reference 60 output connects to the sense amplifier circuit 5 and to the drain and gate of transistor 42. The second current reference 70 output connects to the drain and gate of transistor 43. Transistor 42 acts as a current load for transistor 22 in the sense amplifier circuit 5. Transistor 43 as a duplicate of transistor 42 further assures that the current through points 60 and 70 is the same.

Transistor 52 and 42 together act as a "drain follower" stage where transistor 42, the load device, acts as the nonlinear "resistor." This combination provides current gain without saturation or "clipping". The same description applies to transistor 53 and 43. Sense amplifier input 50 connected to the drain and gate of transistor 41 completes the symmetry of the circuit layout. Input 50 is the data line coming from the read-only-memory (ROM) and transistor 41 acts as the current sink similar to transistors 42 and 43.

The sense amplifier circuit 5 is a differential sense amplifier. Input 50 is the sense amplifier input with a current swing corresponding to "0" or "1" data. First current reference 60 is the other input to the sense amplifier circuit. Terminal 40 is the sense amplifier output. When the current flowing into sense amplifier input 50 reaches a logic "1" or about 10 microamperes then the voltage across n-channel transistor 41 rises as well. This causes n-channel transistor 21 to conduct and terminal 20 voltage to drop. Since the gate of p-channel transistor 31 is connected to terminal 20, the dropping gate voltage will cause load transistor 31 to start conducting. This will pull up its drain (terminal 20) and stabilizes the circuit operating point. Since the gate of p-channel transistor 32 is also connected to terminal 20 the dropping gate voltage will turn on transistor 32. Its drain voltage (terminal 30) will therefore rise. Inverting amplifier 23, connected at its input to terminal 30 and at its output to sense amplifier output 40, amplifies this voltage swing considerably and the voltage at Output 40 will swing low.

When the current flowing into sense amplifier input 50 drops to zero or logic "0" then the voltage at the gate of transistor 21 drops as well, cutting off transistor 21. The voltage at terminal 20, and gate of transistor 31 rises. This cuts off transistor 31 and the voltage at its drain (terminal 20) would want to drop. The circuit reaches a second stabilizing operating point. Since transistor 32 is also cut off, its drain voltage (terminal 30) drops as well and inverting amplifier 23 will produce a high voltage at sense amplifier output 40. Transistors 21 and 22 have the same channel width and length and transistors 31 and 32 have the same channel width and length. They are also to be placed adjacent to each other to insure similar circuit operating points.

Advantages of the current reference circuit of the present invention are that a) duplicate branches of the current reference circuit set up the sum of the differential currents for both "0" and "1" data, b) the mid-point reference is robust enough to handle distinctively different levels of "0" and "1" currents without causing the mid-point current to clip near the "0" or "1" level, c) this characteristic ensures adequate sensing levels for the bitline sense amplifier to amplify the ROM cell data, and d) placing duplicate components in close proximity reduces mid-point current reference sensitivity to fabrication process variations.

While the invention has been particularly shown and described with reference to the preferred embodiments thereof, it will be understood by those skilled in the art that various changes in form and details may be made without departing from the spirit and scope of the invention.

What is claimed is:

1. A current reference circuit for a current-mode read-only-memory (ROM) comprising:

a supply voltage;

a reference potential;

a reference circuit connected to said supply voltage, said reference circuit having output terminals A and B, and a control input, said reference circuit providing a reference signal for logical "0" data at said terminal A and logical "1" data at said terminal B;

a current averaging circuit having an input A connected to said terminal A, an input B connected to said terminal B, an input C connected to said control input, a feed input to receive a gating signal from memory bitlines of said ROM, a feed output to provide an averaged signal of said terminals A and B to said memory bitlines of said ROM, and a first and a second current reference output;

a sense amplifier, connected to said supply voltage and said reference potential, said sense amplifier having a first and a second sense amplifier input, said first sense amplifier input connected to one of said memory bitlines of said ROM, said second sense amplifier input connected to said first current reference output, said sense amplifier receiving a sense signal at said first sense amplifier input and providing an amplified sense signal at a sense amplifier output; and a current load circuit with a first, a second, and a third load input, said first load input connected to said first current reference output, said second load input connected to said second current reference output, said third load input connected to said first sense amplifier input, said current load circuit providing a current sink at said first and said second load input, and a current source at said first and said third load input.

2. The circuit of claim 1, wherein said reference circuit further comprises:

a first n-channel transistor having a gate, a source and a drain, said gate of said first n-channel transistor connected to said supply voltage, said source of said first n-channel transistor connected to said reference potential, said drain of said first n-channel transistor connected to said terminal A;

a first p-channel transistor having a gate, a source and a drain, said gate of said first p-channel transistor connected to said control input, said source of said first p-channel transistor connected to said supply voltage, said drain of said first p-channel transistor connected to said terminal A, and a second p-channel transistor having a gate, a source and a drain, said gate of said second p-channel transistor connected to said control input, said source of said second p-channel transistor connected to said supply voltage, and said drain of said second p-channel transistor connected to said terminal B.

3. The circuit of claim 2, wherein said terminal A establishes a current reference for logical "0" data at the junction of said first n-channel transistor and said first p-channel transistor.

4. The circuit of claim 2, wherein said terminal B establishes a current reference for logical "1" data at said drain of said second p-channel transistor.

5. The circuit of claim 2, wherein said first and said second p-channel transistor of said reference circuit are placed adjacent to each other on an integrated semiconductor chip so as to minimize device parameter variations.

6. The circuit of claim 1, wherein said averaging circuit further comprises:

a first p-channel transistor having a gate, a source and a drain, said gate of said first p-channel transistor connected to said feed input, said source of said first p-channel transistor connected to said input A, said drain of said first p-channel transistor connected to said feed output;

a second p-channel transistor having a gate, a source and a drain, said gate of said second p-channel transistor connected to said feed input, said source of said second p-channel transistor connected to said input B, said drain of said second p-channel transistor connected to said drain of said first p-channel transistor;

a third p-channel transistor having a gate, a source and a drain, said gate of said third p-channel transistor connected to said input C, said source of said third p-channel transistor connected to said feed output, said drain of said third p-channel transistor connected to said first current reference output, and a fourth p-channel transistor having a gate, a source and a drain, said gate of said fourth p-channel transistor connected to said input C, said source of said fourth p-channel transistor connected to said feed output, and said drain of said fourth p-channel transistor connected to said second current reference output.

7. The circuit of claim 6, wherein said first, said second, said third, and said fourth p-channel transistor of said averaging circuit are placed adjacent to each other on an integrated semiconductor chip so as to minimize device parameter variations.

8. The circuit of claim 6, wherein said averaging circuit sums the currents flowing through said terminal A and said terminal B by the connection of said drains of said first and said second p-channel transistor of said averaging circuit.

9. The circuit of claim 8, wherein the resultant current from said summed current is divided evenly between said first and said second current reference output.

10. The circuit of claim 9, wherein said current divided evenly between said first and said second current reference output has a magnitude half way between said reference signal for said logical "0" data and said logical "1" data.

11. The circuit of claim 1, wherein said current load circuit further comprises:

a first n-channel transistor having a gate, a source and a drain, said gate and said drain of said first n-channel transistor connected to said first load input, said source of said first n-channel transistor connected to said reference potential;

a second n-channel transistor having a gate, a source and a drain, said gate and said drain of said second n-channel transistor connected to said second load input, and said source of said second n-channel transistor connected to said reference potential; and a third n-channel transistor having a gate, a source and a drain, said gate and said drain of said third n-channel transistor connected to said third load input, said source of said third n-channel transistor connected to said reference potential.

12. The circuit of claim 11, wherein said first, said second, and said third n-channel transistor of said current mirror circuit are placed adjacent to each other on an integrated semiconductor chip so as to minimize device parameter variations.

13. The circuit of claim 1, wherein said sense amplifier circuit further comprises:

a first n-channel transistor having a gate, a source and a drain, said gate of said first n-channel transistor connected to said first sense amplifier input, said source of said first n-channel transistor connected to said reference potential;

a first p-channel transistor having a gate, a source and a drain, said gate and said drain of said first p-channel transistor connected to said drain of said first n-channel transistor, said source of said first p-channel transistor connected to said supply voltage;

a second p-channel transistor having a gate, a source and a drain, said gate of said second p-channel transistor connected to said drain of said first n-channel transistor, said source of said second p-channel transistor connected to said supply voltage;

a second n-channel transistor having a gate, a source and a drain, said gate of said second n-channel transistor connected to said second sense amplifier input, said source of said second n-channel transistor connected to said reference potential, said drain of said second n-channel transistor connected to said drain of said second p-channel transistor, and an inverting amplifier, with an input and an output, the input of said inverting amplifier connected to said drain of said second p-channel transistor, and the output of said inverting amplifier connected to said sense amplifier output.

* * * * *